US005910704A

United States Patent [19]

Choo

[11] Patent Number: 5,910,704

[45] Date of Patent: Jun. 8, 1999

[54] FIELD EMISSION DISPLAY WITH A PLURALITY OF GATE INSULATING LAYERS HAVING HOLES

[75] Inventor: Dae-ho Choo, Seoul, Rep. of Korea

[73] Assignee: Samsung Display Devices Co., Ltd., Kyungki-do, Rep. of Korea

[21] Appl. No.: 08/723,125

[22] Filed: Sep. 30, 1996

[30] Foreign Application Priority Data

Oct. 31, 1995 [KR] Rep. of Korea ..... 95-39059

[51] Int. Cl.[6] ..... H01J 1/62; H01J 63/04

[52] U.S. Cl. ..... 313/495; 313/497; 313/306; 313/307; 313/308; 313/336

[58] Field of Search ..... 313/495, 309, 313/336, 351, 355, 496, 497, 307, 308, 306

[56] References Cited

U.S. PATENT DOCUMENTS

| | | | |
|---|---|---|---|
| 4,940,916 | 7/1990 | Borel et al. | 313/306 |
| 5,064,396 | 11/1991 | Spindt | 445/50 |
| 5,075,591 | 12/1991 | Holmberg | 313/495 |
| 5,089,292 | 2/1992 | MaCaulay et al. | 427/78 |
| 5,163,328 | 11/1992 | Holland et al. | 73/717 |
| 5,191,217 | 3/1993 | Kane et al. | 313/308 |
| 5,319,279 | 6/1994 | Watanabe et al. | 313/309 |
| 5,723,867 | 3/1998 | Imura | 313/309 |

FOREIGN PATENT DOCUMENTS 6-84454 3/1994 Japan .

OTHER PUBLICATIONS

Itoh et al., "Investigation of Cathodoluminescent Display Device with Field Emission Cathodes", Jpn. J. Appl. Phys., vol. 32, 1993, pp. 3955–3961.

*Primary Examiner*—Jay M. Patidar
*Attorney, Agent, or Firm*—Foley & Lardner

[57] ABSTRACT

A field emission display includes a substrate with a plurality of cathode layers provided thereon. A plurality of micro tips are provided on each of the cathode layers. A plurality of gate insulating layers are also provided on the cathode layers, each of the gate insulating layers having a plurality of holes for accommodating each unit of the micro tips. A plurality of gate electrodes are provided on the gate insulating layers, each of the gate electrodes having a plurality of holes corresponding to each hole of the plurality of gate insulating layers, each of the plurality of gate insulating layers and each of the plurality of gate electrodes being alternately provided on each other.

2 Claims, 15 Drawing Sheets

FIELD EMISSION DISPLAY WITH A PLURALITY OF GATE INSULATING LAYERS HAVING HOLES

BACKGROUND OF THE INVENTION

The present invention relates to a field emission display and fabricating methods therefor, and more particularly, to a field emission display having improved field emission effect of a micro tip owing to a tunnelling effect of multiple gate electrodes and fabricating methods therefor.

Japanese Patent Laid-Open Publication No. hei 6-84454 discloses a field emission display of a typical Spindt type. As shown in FIG. 1, in the field emission display of the conventional Spindt type, a plurality of cathode layers 1 are provided on a substrate 9, and a plurality of resistive layers 2 are provided on each cathode layer 1. A micro tip 5 is formed on each resistive layer 2. The micro tip 5 is housed inside a well 3*a* in a gate insulating layer 3 provided on the deposited layers. A gate electrode 4 having a hole 4*a* corresponding to the cavity 3*a* is deposited on the gate insulating layer 3.

In such a conventional field emission display, field emission from the micro tip 5 due to an electric field induced by a voltage difference between the cathode layer 1 and the gate electrode 4 is obtained. Since an electric field between the gate electrode 4 and the micro tip 5 is formed by a single gate electrode 4, the field is concentrated on a tip portion 6 of the micro tip 5. Thus, emission of electrons due to the tunnelling effect at the tip 5 becomes difficult.

That is, an electric barrier is formed since the field is mainly applied to the tip portion 6 of the micro tip 5 and electrons are transferred from the lower portion of the micro tip 5 to the upper portion thereof. Thus, the electrons do not sufficiently concentrate on the tip portion 6 of the micro tip 5. To overcome the deterioration in mobility of electrons due to the electric barrier, an application voltage should be increased to form a strong electric field. Accordingly, consumption of electric power increases as well as mass generation of Joule heat thereby causing thermal degradation. Also, when a higher voltage is applied, the problem of leakage currents occurs. That is, electric current can be leaked through the gate insulating layer 3 between the cathode layer 1 and the gate electrode 4.

The current leakage through the gate insulating layer 3 can be overcame by thickening the gate insulating layer 3 beyond a particular value as shown in U.S. patent Ser. No. 5,064,396. However, when the thickness of the gate insulating layer 3 is increased, physical stress is generated therein thereby curtailing the life span of the display.

SUMMARY OF THE INVENTION

To solve the above problems, it is a first object of the present invention to provide a field emission display structured to efficiently emit a massive amount of electrons.

It is a second object of the present invention to provide a method for fabricating the field emission display which attains the first object.

Accordingly, to achieve the first object, there is provided a field emission display comprising:

a substrate;

a plurality of cathode layers provided on said substrate;

a plurality of micro tips provided on each of said cathode layers, a plurality of gate insulating layers formed on said cathode layers, each of the gate insulating layers having a plurality of holes for accommodating each unit of said micro tips; and a plurality of gate electrodes deposited on said gate insulating layers, each of the gate electrodes having a plurality of holes corresponding to each hole of said plurality of gate insulating layers, each of said plurality of gate insulating layers and each of said plurality of gate electrodes being alternately deposited on each other.

To achieve the first object, there is also provided a field emission display according to another aspect of the present invention comprising:

a field emission display device comprising:

a substrate;

a plurality of cathode layers provided on said substrate;

a micro-tip provided on said cathode layer;

a plurality of insulating layers each having a plurality of first holes and provided on and above said cathode layers; and a plurality of gate electrodes having second holes; said each insulating layer and said each gate electrode being alternately disposed over each other.

To achieve the second object, there is provided a fabricating method for a field emission display comprising the steps of:

(a) forming a plurality of cathode layers in a predetermined pattern on a substrate;

(b) forming gate insulating layers on the surface of each of said cathode layers;

(c) forming gate electrode layers on the entire surface of said gate insulating layers perpendicular to said plurality of cathode layers;

(d) repeating said steps (b) and (c) at least one or more times;

(e) forming a mask pattern having a plurality of apertures disposed on the uppermost gate electrode;

(f) forming a well by etching through said apertures a portion of said gate insulating layers and said gate electrodes;

(g) removing said mask pattern;

(h) forming a parting layer on the uppermost gate electrode by metal evaporation in a predetermined direction;

(i) depositing metal at said parting layer and the bottom of said well by vaporizing a predetermined metal onto said parting layer in a vertical direction to form a micro tip above said cathode layers of said well bottom; and (j) removing said metal by removing said parting layer itself.

Also it is possible that forming said well by etching through the aperture up to said lowermost gate insulating layer and then removing the mask pattern.

To achieve the second object, there is provided a fabricating method for a field emission display according to another aspect of the present invention comprising the steps of:

(a) forming a plurality of cathode layers in a predetermined pattern on a substrate;

(b) forming gate insulating layers on the surface of each of said cathode layers;

(c) forming gate electrode layers on the entire surface of said gate insulating layers perpendicular to said plurality of cathode layers;

(d) repeating said steps (b) and (c) at least one or more times;

(e) forming a mask pattern having a plurality of apertures disposed on the uppermost gate electrode;

(f) forming a well on the lowermost gate insulating layer by etching through said aperture a portion of said gate insulating layer and said gate electrode exclusive of the lowermost gate insulating layer disposed above said cathode layer;

(g) removing said mask pattern;

(h) etching the lowermost gate insulating layer disposed at the bottom of said well to thereby expose said cathode layer to bottom of said well;

(i) forming a parting layer on the uppermost gate electrode by metal evaporation in a predetermined direction;

(j) depositing metal at said parting layer and the bottom of said well by vaporizing a predetermined metal onto said parting layer in a vertical direction to form a micro tip above said cathode layers of said well bottom; and (k) removing said metal by removing said parting layer itself.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 1:
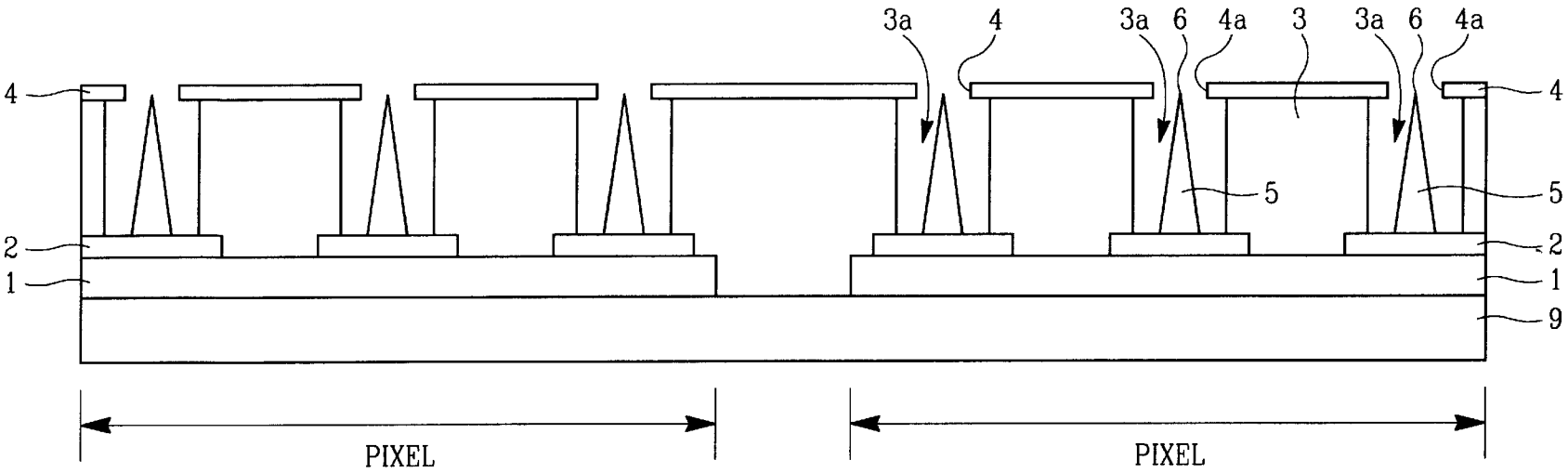
Fig. 1 (Prior Art)
FIG. 1 is a sectional view schematically illustrating a conventional field emission display.
Figure 2:
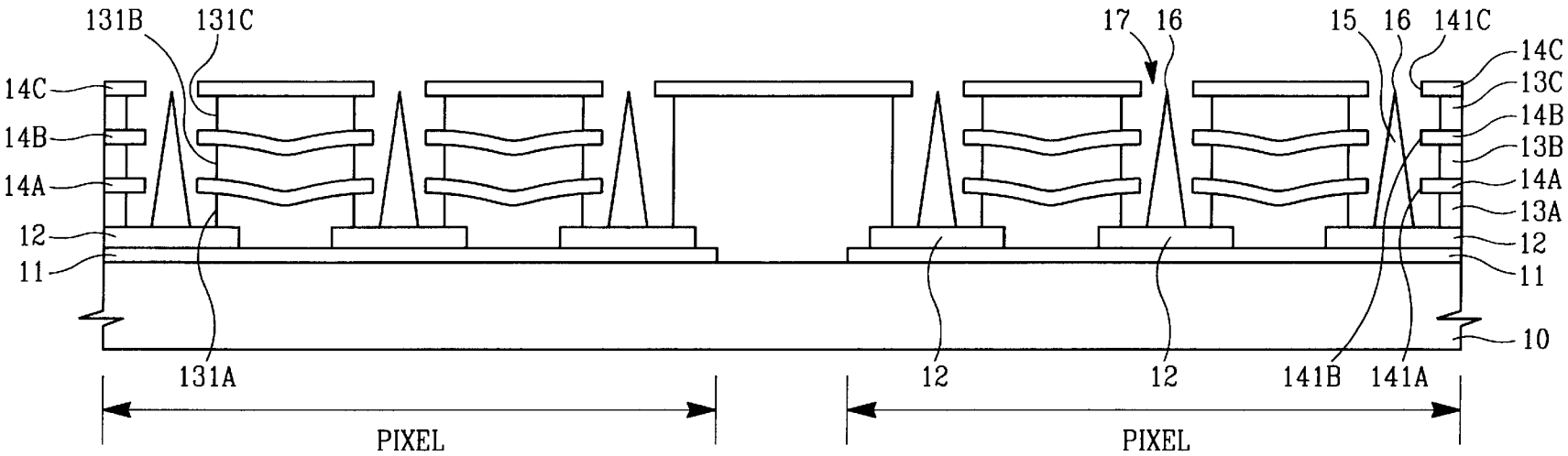
FIG. 2 is a sectional view schematically illustrating a field emission display according to the present invention.

FIG. 2 shows a schematic sectional view of a field emission display according to the present invention.

Referring to FIG. 2, a cathode layer 11 arranged in a predetermined pattern is formed on a substrate 10 and three resistive layers 12 are provided on the cathode layer 11 in a unit of a pixel. A unit micro tip 15 having a sharp tip portion 16 is provided on each resistive layer 12. The micro tip 15 is disposed inside a well 17. The well 17 is formed by a first gate insulating layer 13A, a first gate electrode 14A, a second gate insulating layer 13B, a second gate electrode 14B, a third gate insulating layer 13C and a third gate electrode 14C, each having a hole 131A, 141A, 131B, 141B, 131C and 141C. Here, since the diameters of the holes 141A, 141B and 141C of the gate electrodes 14A, 14B and 14C are smaller than those of the holes 131A, 131B and 131C of the gate insulating layers 13A, 13B and 13C, the edges of the holes 141A, 141B and 141C protrude out of an inside wall of the well 17.

In such a structure, the resistive layer 12 can be removed as a functional selective element. However, it is preferred to provide the resistive layer 12 between the micro tip 15 and the cathode layer 11.

Also, the number of deposition layers of the gate electrodes 14A, 14B and 14C may be changed. Further, it is preferred to form the edges of the holes 141A, 141B and 141C of the gate electrodes 14A, 14B and 14C protruding from the inside wall of the well 17 for forming an efficient field. However, it may be possible to form the edges of the holes 141A, 141B and 141C not to protrude from the inside wall.

The array of multiple gate electrodes of such a structure forms multifold fields with respect to the micro tip which is an electron emission source to thereby emit a large quantity depositing Cr, Al and Mo employing a electron beam evaporation method or sputtering method. Here, the first gate electrode 14A is disposed in a direction perpendicular to the cathode layer 11, as shown in FIGS. 3A–3F.

Figure 3A:
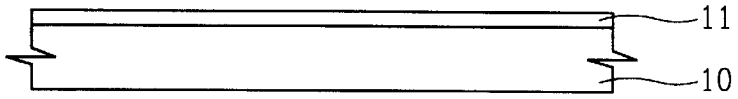
FIGS. 3A–3V are processing views of fabrication of the field emission display as shown in FIG. 2 according to the present invention.
Figure 3B:
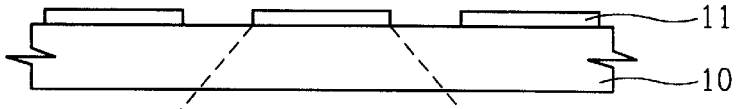
Figure 3C:
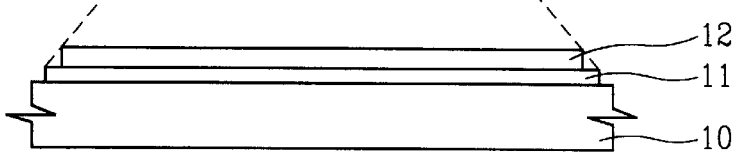
Figure 3D:
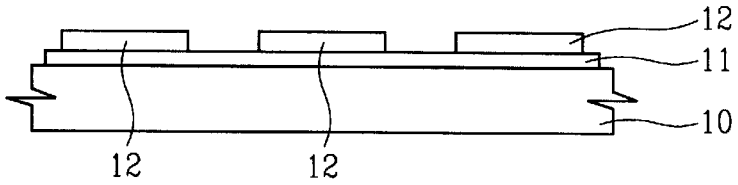
Figure 3E:
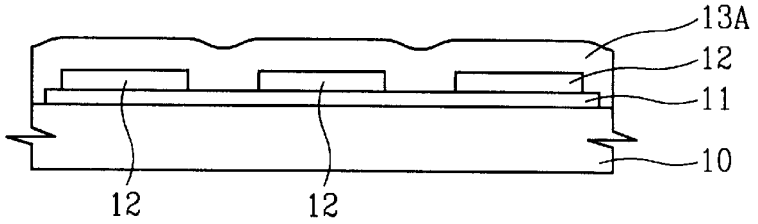
Figure 3F:
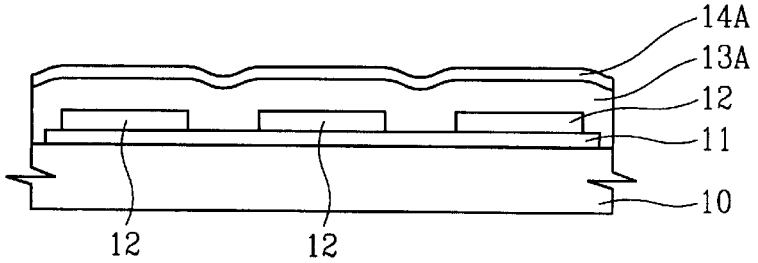
Figure 3G:
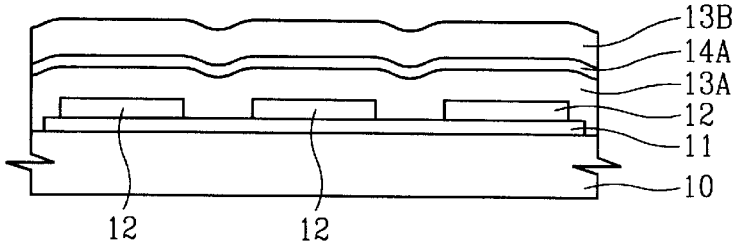
Figure 3H:
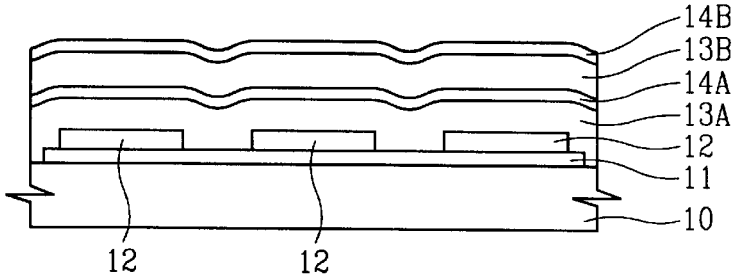
Figure 3I:
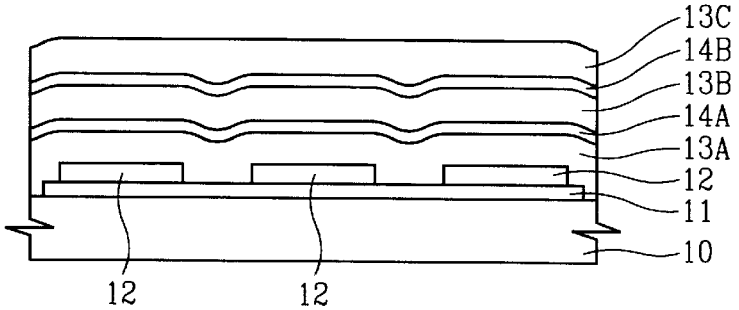

As shown in FIGS. 3G–3J, a second gate insulating layer 13B, a second gate electrode 14B, a third gate insulating layer 13C and a third gate 14C are sequentially deposited on the resultant of FIG. 3F using the same method employed in the above steps.

Figure 3J:
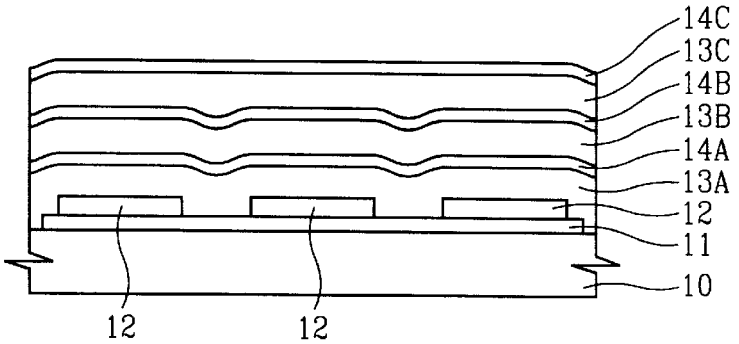
Figure 3K:
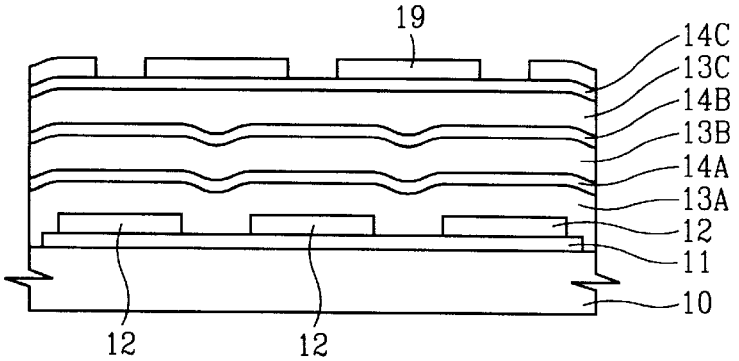
Figure 3L:
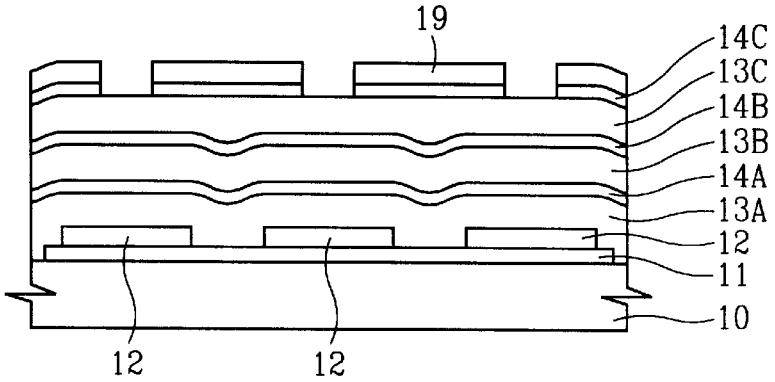
Figure 3M:
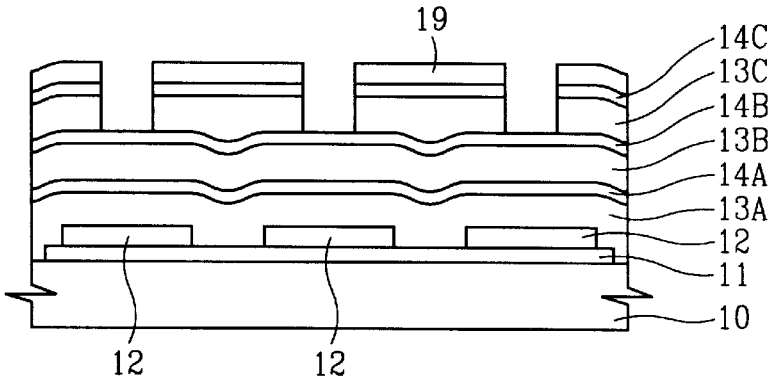
Figure 3N:
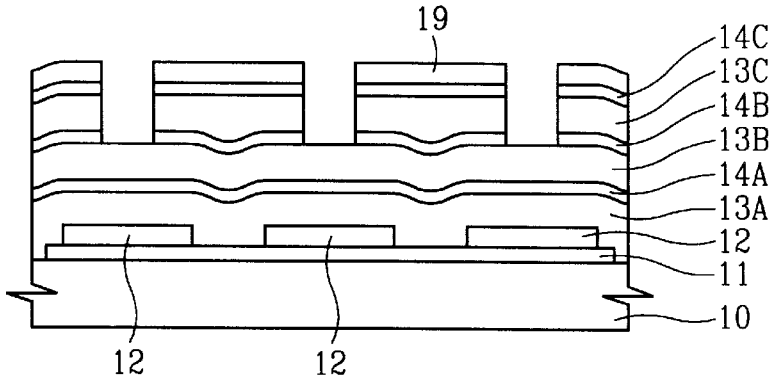
Figure 3O:
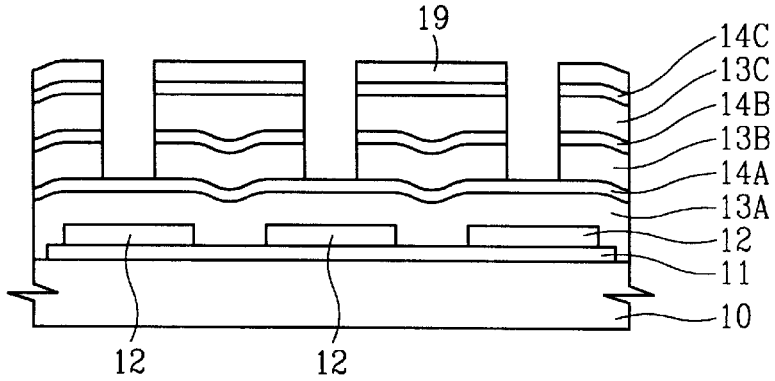
Figure 3P:
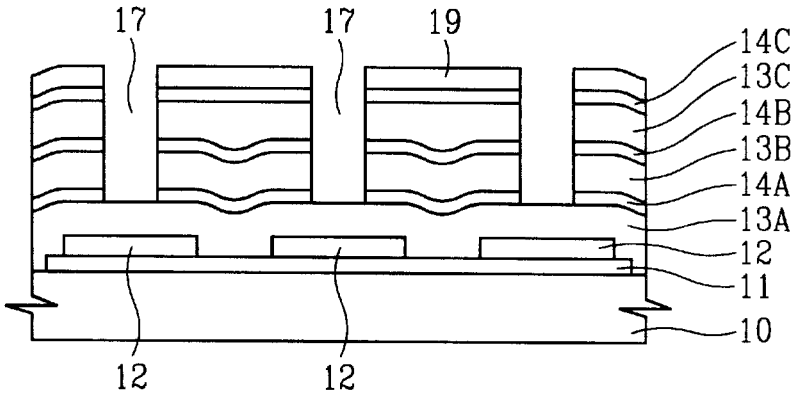

In FIG. 3K, a mask pattern 19 having an aperture disposed right overhead of the resistive layer 12 is formed by depositing photoresist on the resultant of FIG. 3J using a spin-coating method and patterning the same by photolithography.

In FIGS. 3L–3P, the deposited layers which are disposed right under the aperture of the mask pattern 19 are etched step by step down to the first gate insulating layer 13A. The gate electrodes 14A, 14B and 14C are etched by dry-etching using chlorine-series reactive gas like $Cl_2$ or $SiCl_4$ plasma, and the gate insulating layers 13B and 13C are etched by dry-etching using a fluorine-series reactive gas like $CF_4$ and $CHF_3$ plasma.

Figure 3Q:
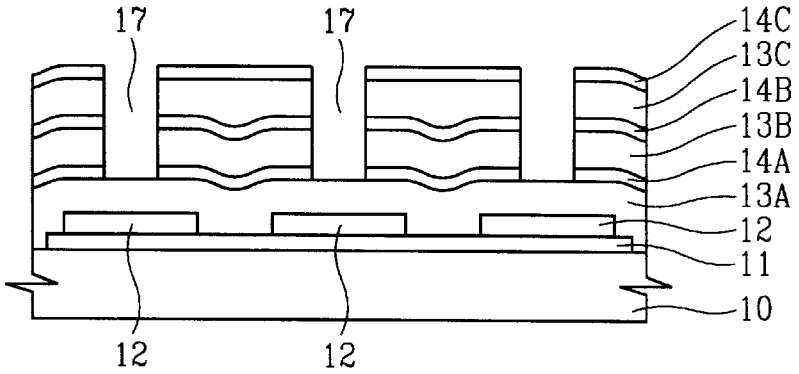

In FIG. 3Q, the mask pattern 19 is burnt off by using $O_2$ plasma and a residue is removed by wet-etching using etchant.

Figure 3R:
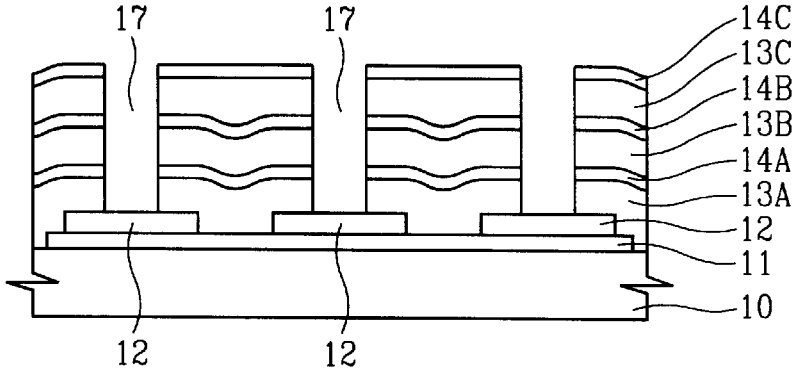

In FIG. 3R, the first gate insulating layer 13A disposed at the bottom of the well 17 and on the resistive layer 12 is removed to thereby expose the resistive layer 12.

Figure 3S:
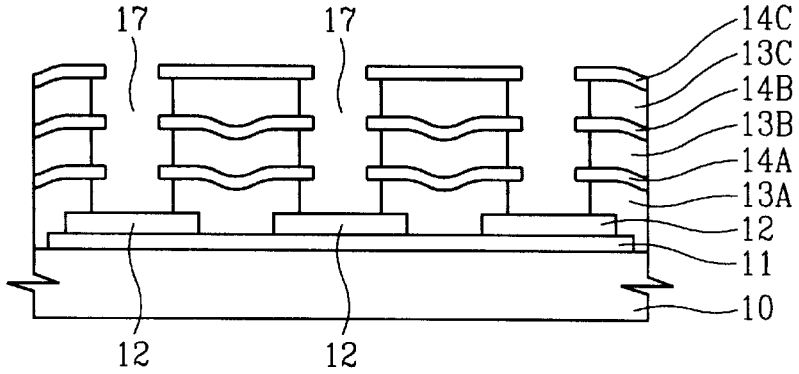

In FIG. 3S, by etching the exposed insulating layers 13A, 13B and 13C toward the inside wall of the well 17 to a predetermined depth by employing an isotropic wet-etching method which uses a BOE (buffered oxide etching) solution, the edges of the holes 141A, 141B and 141C of the gate electrodes 14A, 14B and 14C are protruded from the inside wall of the well 17.

Figure 3T:
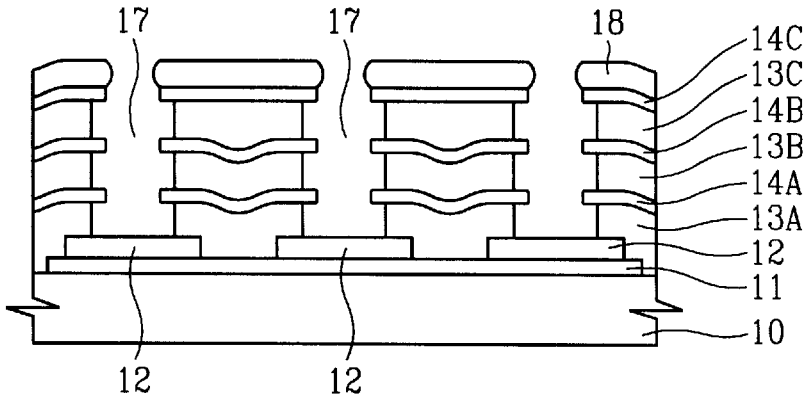

In FIG. 3T, a parting layer 18 is formed to a thickness of 3000 Å by depositing Al or Cu using an F-beam evaporator having a tilt of 15°.

Figure 3U:
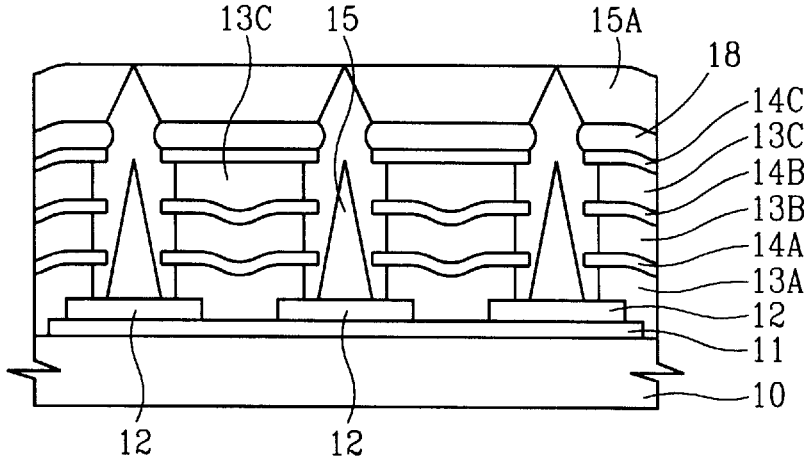

In FIG. 3U, a sacrifice layer 15A and a micro tip 15 are formed to a thickness of 1.5 $\mu$m by vertically depositing Mo, W and Ni with respect to the substrate using an E-beam evaporator having a tilt of 90°.

Figure 3V:
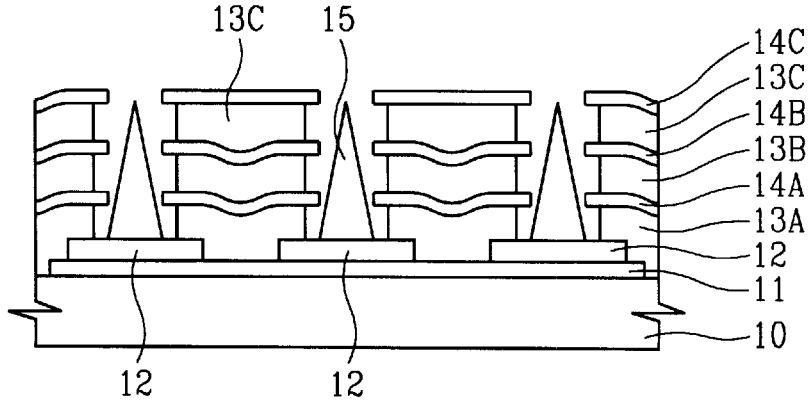

In FIG. 3V, the parting layer 18 and sacrifice layer 15A are removed to thereby expose the micro tip 15 left at the bottom of the well 17.

In the preferred embodiment of the present invention as described above, when the well is formed, the resistive layer where the micro tip is formed is exposed by removing the lowermost insulating layer after the photoresist film is removed in a state where the lowermost gate insulating layer is left. However, in another preferred embodiment described later, a portion for forming a micro tip is exposed after the lowermost gate insulating layer is etched.

Figure 4:
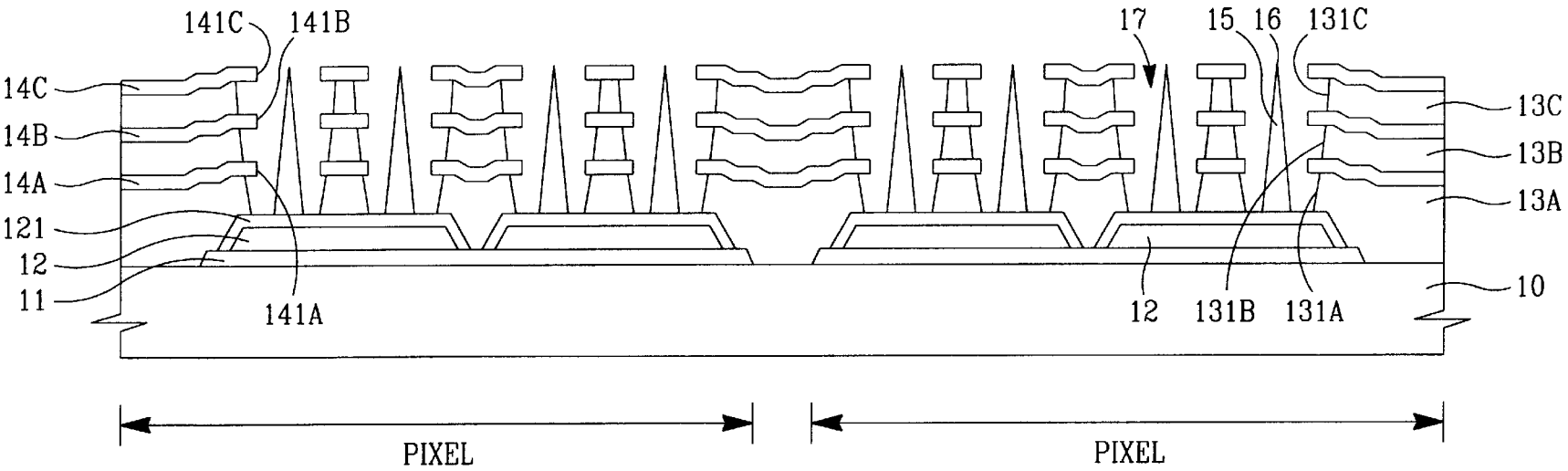
FIG. 4 is a sectional view schematically illustrating a field emission display according to another preferred embodiment of the present invention.

First, a structure of a field emission display according to another preferred embodiment of the present invention will be described referring to FIG. 4.

A plurality (two units in FIG. 4) of resistive layers 12 are provided on each cathode layer 11 arrayed in a predetermined pattern on a substrate 10. An etching barrier 121 is formed on each resistive layer 12. One or more units (two units in the drawing) of a micro tip 15 having a sharp tip portion 16 are formed on the etching barrier 121. The micro tip 15 is disposed inside a well 17. The well 17 is formed by each hole 131A, 141A, 131B, 141B, 131C and 141C made in sequentially deposited gate insulating layers, and gate electrodes. Here, since the diameters of the holes 141A, 141B and 141C of the gate electrodes 14A, 14B and 14C are smaller than those of the holes 131A, 131B and 131C of the gate electrodes 13A, 13B and 13C, the edges of the holes 141A, 141B and 141C are protruded from an inside wall of the well 17.

Figure 5A:
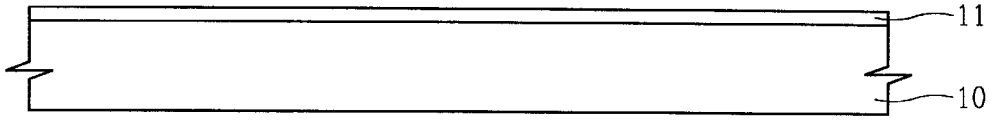
FIGS. 5A–5W are processing views of fabrication of the field emission display as shown in FIG. 4 according to the present invention.
Figure 5B:
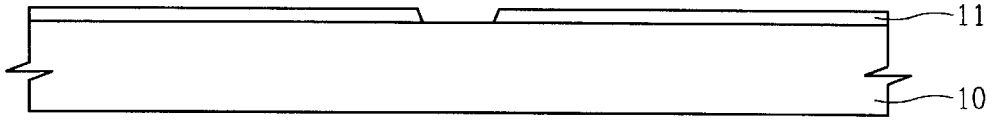
Figure 5C:
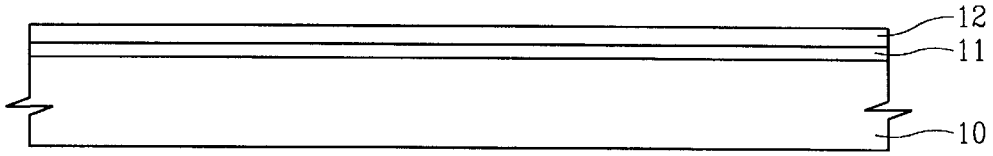
Figure 5D:
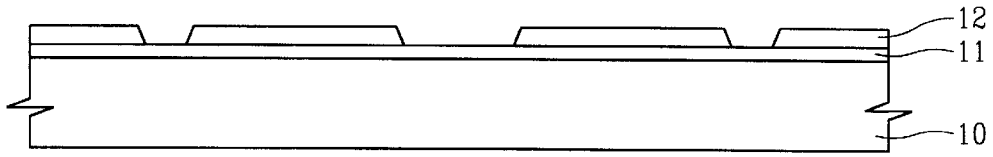
Figure 5E:
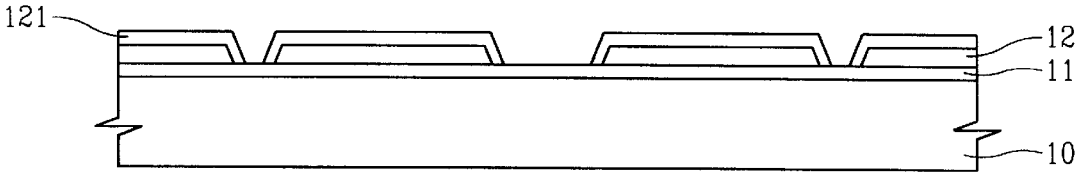
Figure 5F:
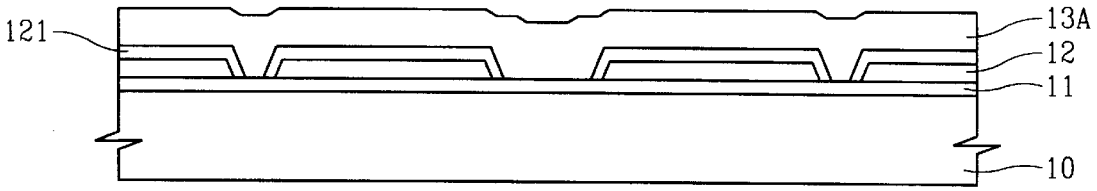
Figure 5G:
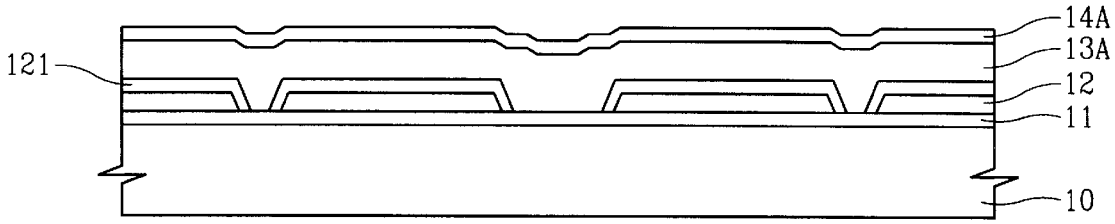
Figure 5H:
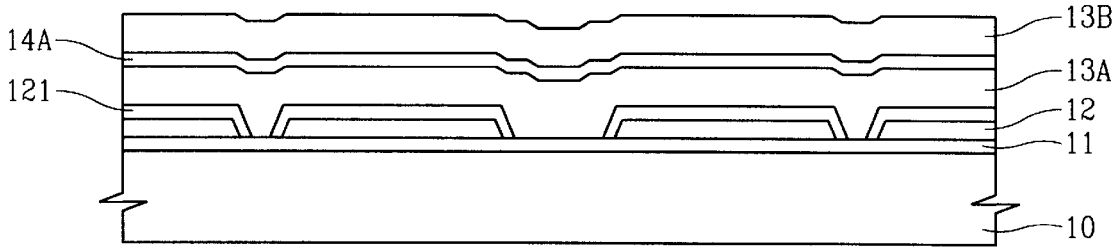
Figure 5I:
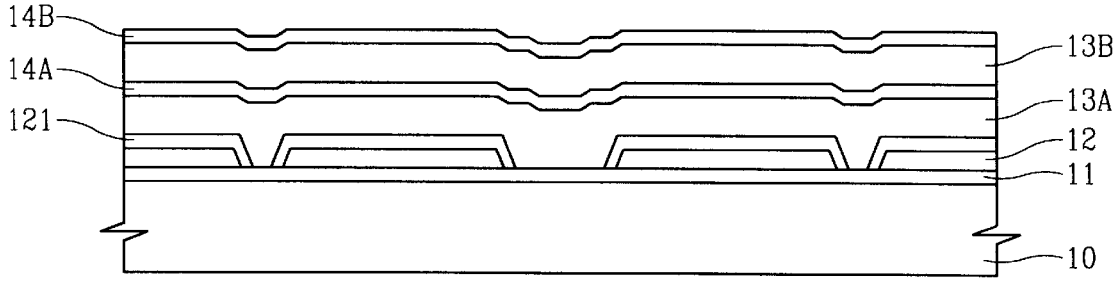
Figure 5J:
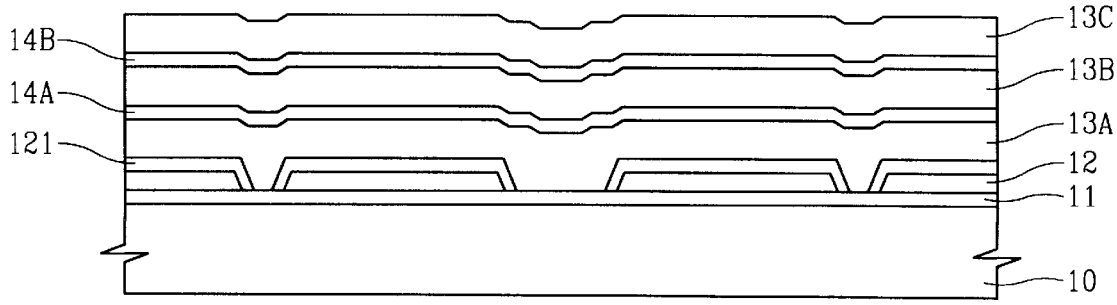
Figure 5K:
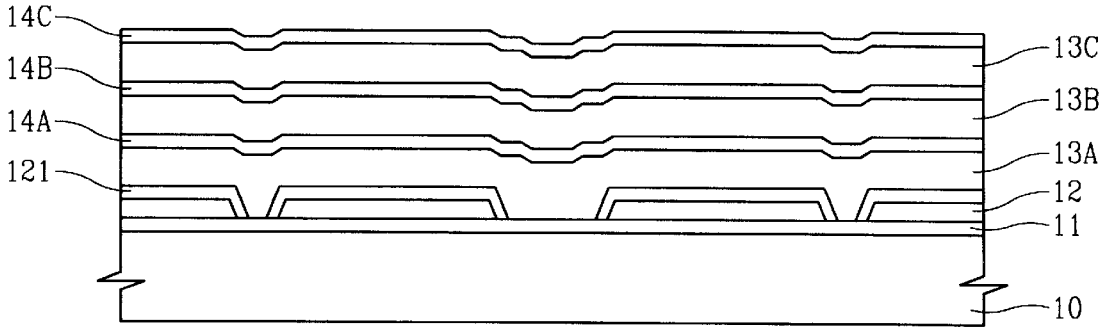
Figure 5L:
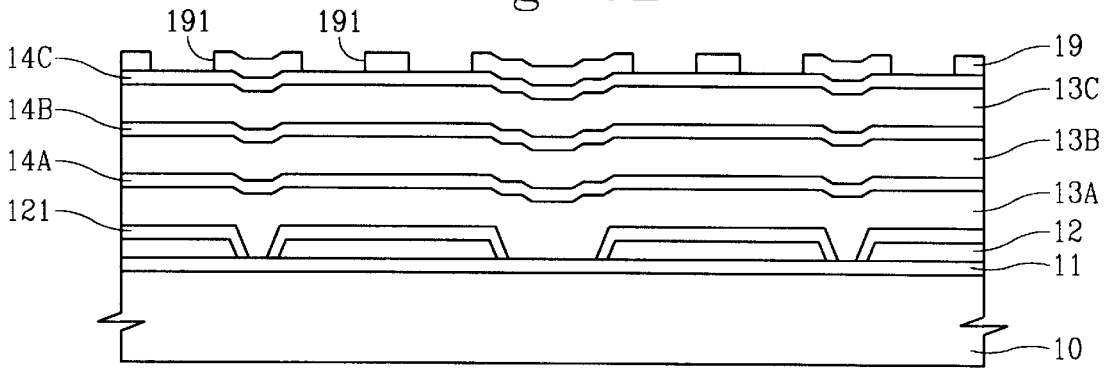
Figure 5M:
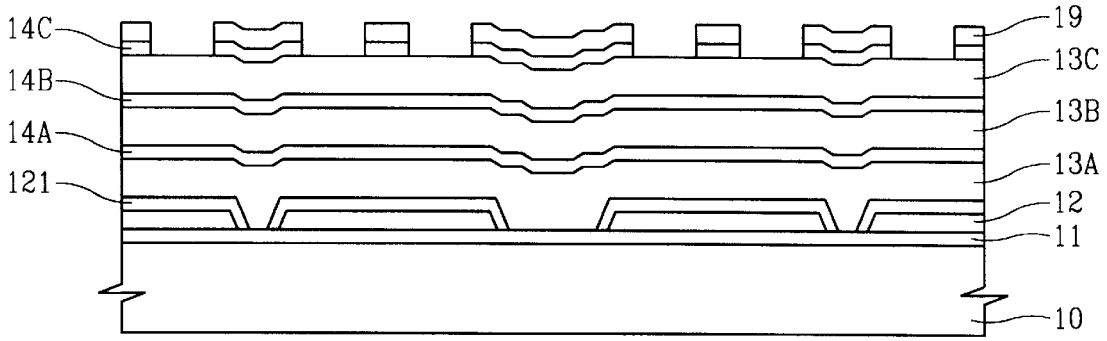
Figure 5N:
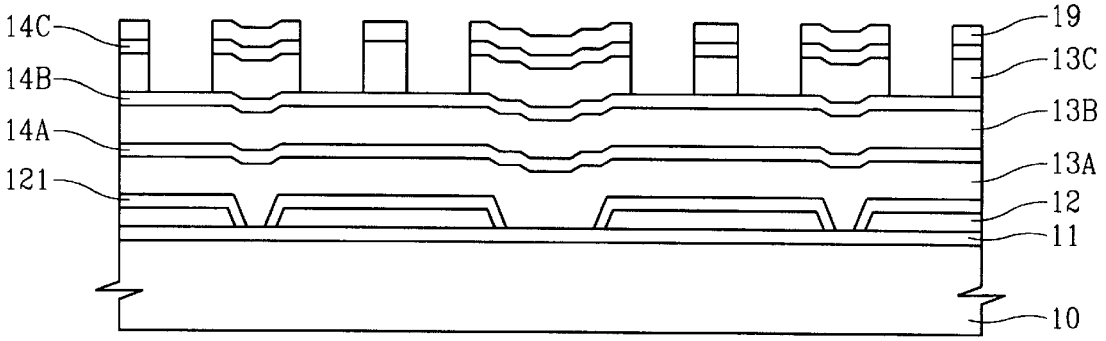
Figure 5O:
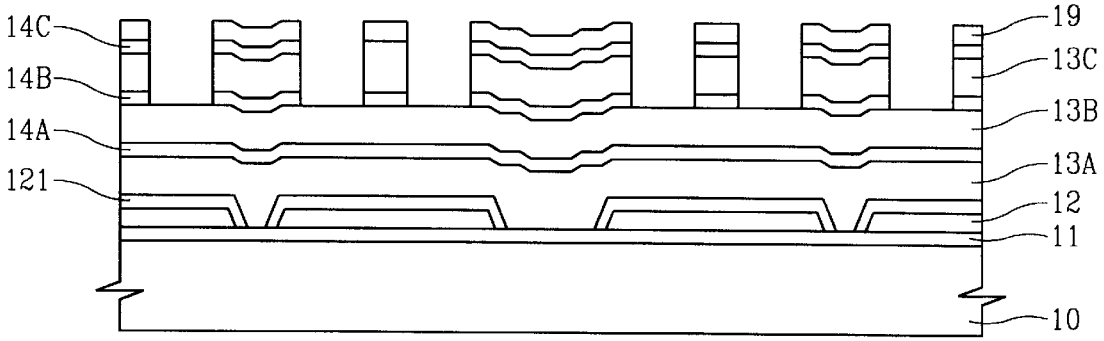
Figure 5P:
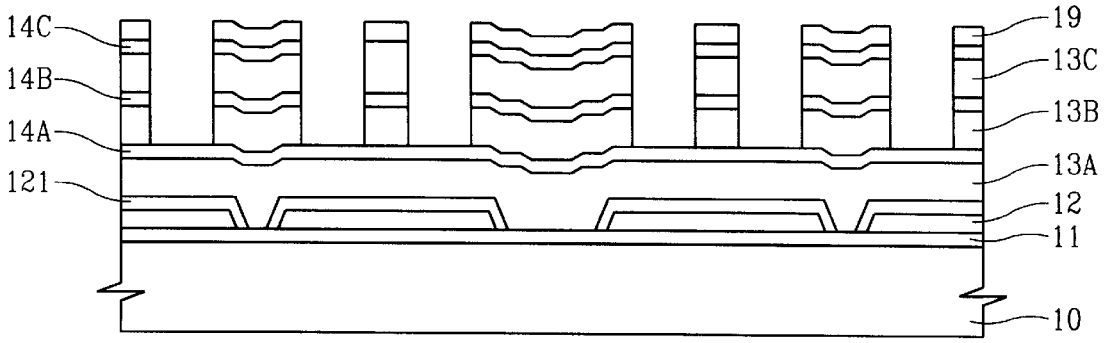
Figure 5Q:
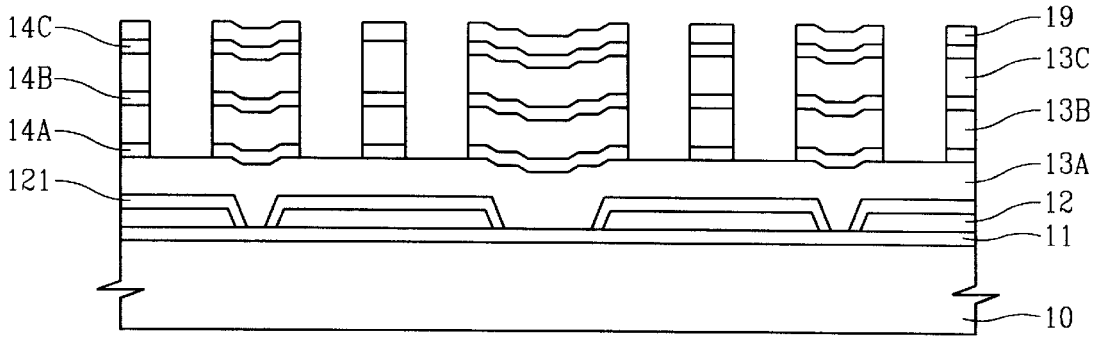
Figure 5R:
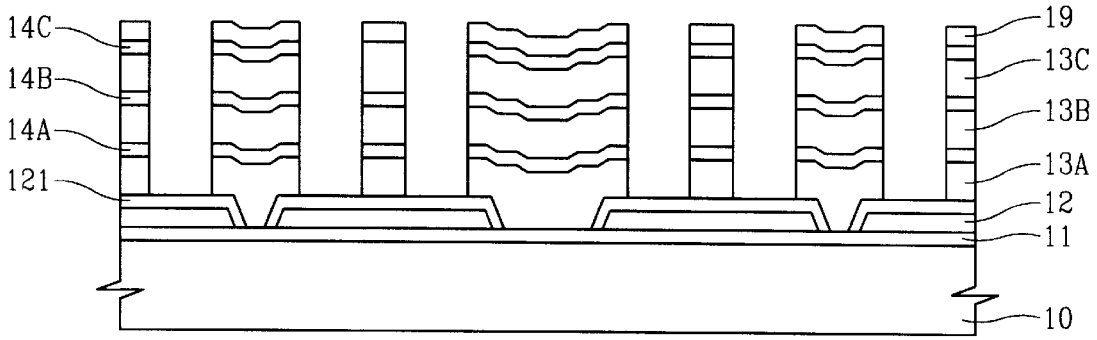
Figure 5S:
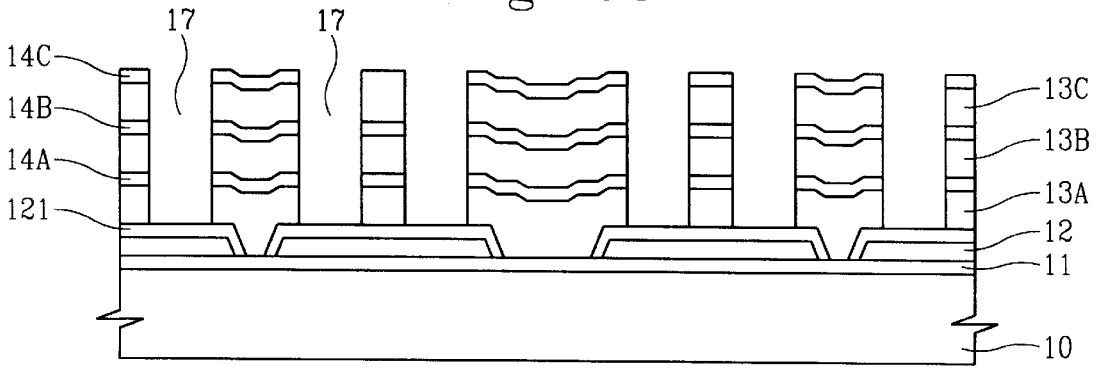
Figure 5T:
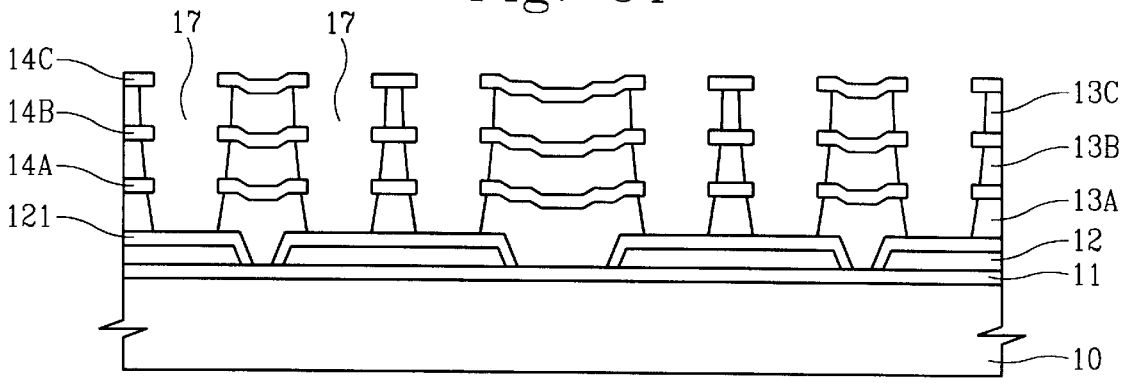
Figure 5U:
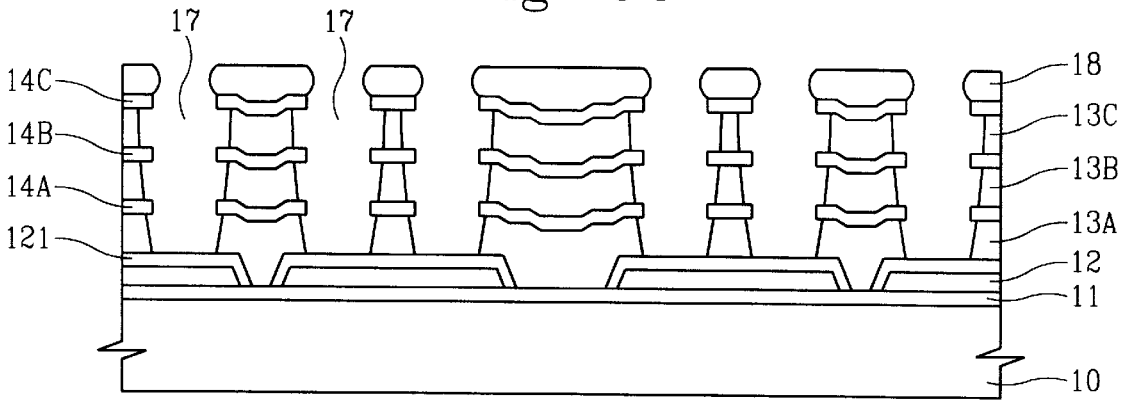
Figure 5V:
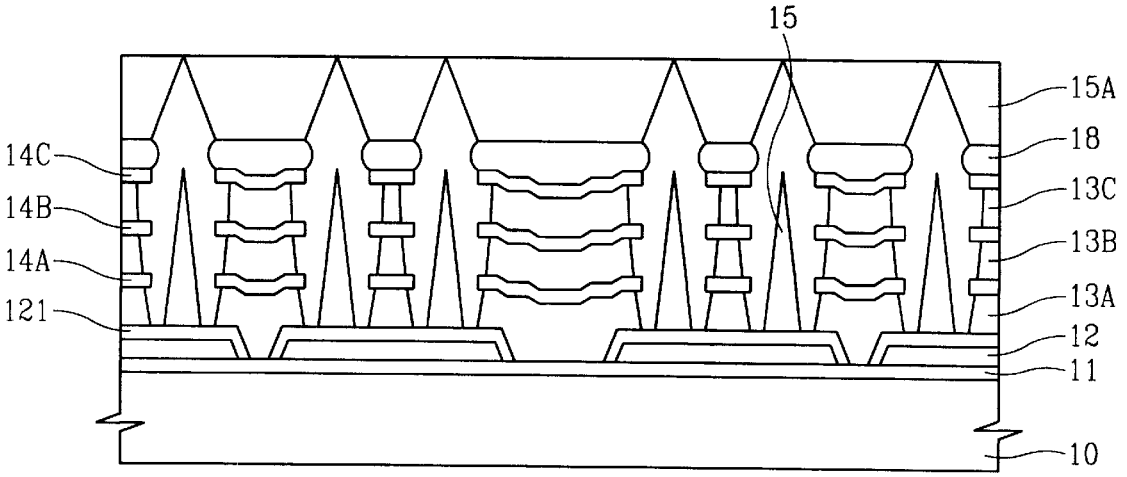
Figure 5W:
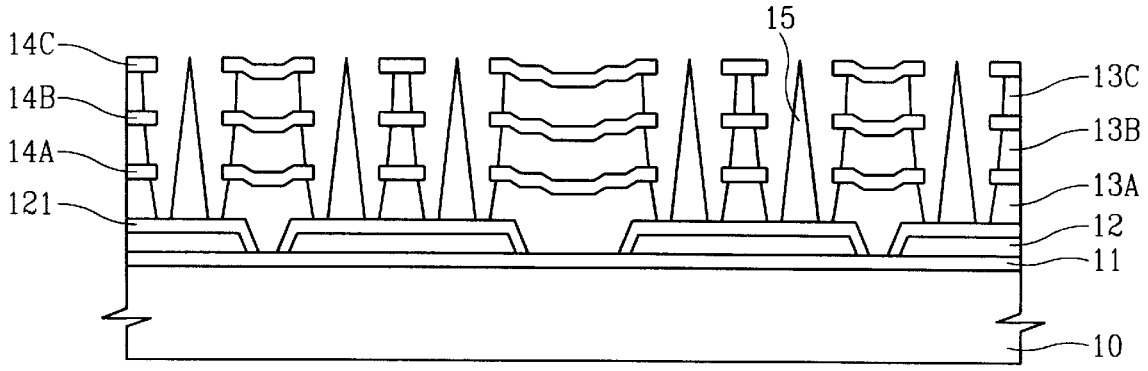

Referring to FIGS. 5A through 5W, a fabricating method for another embodiment of the present invention will be described.

In FIG. 5A, a cathode layer 11 is formed to a thickness of 1000 Å by depositing ITO on a glass substrate 10 by sputtering.

In FIG. 5B, the cathode layer 11 is etched in a predetermined pattern, e.g., a parallel stripe shape by photolithography.

In FIG. 5C, a resistive layer 12 is formed to a thickness of about 3000–5000 Å by depositing a-Si by PECVD or $CrO_2$ sputtering.

In FIG. 5D, one or more resistive layers 12 in a predetermined pattern are left on the cathode layer 11 by etching the resistive layer 12 through dry-etching using $SF_6$ plasma.

In FIG. 5E, an etching barrier 121 is formed in a predetermined pattern by depositing a conductive material, e.g., Cr, on the resistive layer 12.

In FIG. 5F, a first gate insulating layer 13A is formed to a thickness of 3000 Å by depositing $SiO_2$, $Al_2O_3$ and $Si_3N_4$ on the resultant of FIG. 5E by PECVD.

In FIG. 5G, a first gate electrode 14A is formed to a thickness of 1000 Å by depositing Cr, Al and Mo on the first gate insulating layer 13A by E-beam evaporating method or sputtering. Here, the first gate electrode 14A is disposed perpendicular to the cathode layer 11.

As sequentially shown in FIGS. 5H through 5K, a second gate insulating layer 13B, a second gate electrode 14B, a third gate insulating layer 13C and a third gate electrode 14C are sequentially formed by the same methods as those applied in the above steps.

In FIG. 5L, a mask pattern is formed on the resultant of FIG. 5K by a spin-coating method and patterned by photolithography. Thus, a mask pattern 19 having an aperture 191 with the diameter of 1.0 $\mu$m is formed right overhead the resistive layer 12.

As shown in FIGS. 5M through 5R, a deposited layer portion exposed by the aperture 191 of the mask pattern 19 is etched step by step down to the etching barrier 121. Here, the gate electrodes 14A, 14B and 14C are etched by dry-etching using a chlorine-series reactive gas like $Cl_2$ or $SiCl_4$ plasma, and the gate insulating layers 13A, 13B and 13C are etched by dry-etching using a fluorine-series reactive gas like $CF_4$ and $CHF_3$ plasma.

In FIG. 5S, the mask pattern 19 is burnt off by using $O_2$ plasma and the residue is removed by using etchant.

In FIG. 5T, the insulating layers 13A, 13B and 13C forming the inside wall of the well 17 are etched to a predetermined depth by isotropic wet-etching using a BOE solution so that the edge portion of the holes 141A, 141B and 141C of the gate electrodes 14A, 14B and 14C are protruded from the inside wall of the well 17.

In FIG. 5U, a parting layer 18 is formed to a thickness of 3000 Å by depositing Al or Cu by E-beam evaporator having a tilt of 15°.

In FIG. 5V, a micro tip 15 and a sacrifice layer 18 are formed to a thickness of 1.5 $\mu$m by depositing Mo, W or Ni vertically with respect to the substrate 10 by E-beam evaporator having a tilt of 90°.

In FIG. 5W, by removing the sacrifice layer 15A and parting layer 18, the micro tip 15 is left at the bottom of emitted electrons increases to accordingly increase current density. Thus, in accordance with the present invention, the efficiency of the field emission display is maximized since the current density is increased. Such a field emission display can be used as a display device having maximum efficiency as well as a recording device having either a head or a micro wave source.

In the field emission display according to the present invention, the thickness of a unit insulating layer which insulates the cathode layer from the gate electrode can be reduced, (e.g., by ⅓) contrary to the conventional device which adopts a single insulating layer. Hence, in forming each insulating layer, stress of the insulating layer due to heavy thickness is reduced so that reliability can be maintained during driving of the field emission display and power consumption can be decreased by lowering the maximum driving voltage.

What is claimed is:

1. A field emission display comprising:

a substrate;

a plurality of cathode layers provided on said substrate;

a plurality of resistive layers provided on the cathode layers;

a micro tip unit having a plurality of micro tips provided on each resistive layer;

a plurality of gate insulating layers provided on each of said cathode layers, each of said plurality of gate insulating layers having a plurality of holes for accommodating each of said micro tips;

a plurality of gate electrodes provided on said gate insulating layers, each of said plurality of gate electrodes having a plurality of holes corresponding to each hole of said plurality of gate insulating layers, wherein each of said plurality of gate insulating layers and each of said plurality of gate electrodes are alternately provided on each other, and the diameter of said gate electrode holes are smaller than the diameter of said gate insulating layer holes.

2. A field emission display as claimed in claim 1, wherein a plurality of etching barriers that close a surface of said plurality of resistive layers are further provided between said resistive layers and said micro tips.

* * * * *